US006528932B2

(12) United States Patent
Arakawa et al.

(10) Patent No.: US 6,528,932 B2
(45) Date of Patent: Mar. 4, 2003

(54) CRT SOCKET WITH INSULATING INTERFIT BETWEEN FOCUS AND SIGNAL CONTACTS

(75) Inventors: Hiroharu Arakawa, Toyama (JP); Atsushi Arai, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 09/764,219

(22) Filed: Jan. 17, 2001

(65) Prior Publication Data

US 2001/0015606 A1 Aug. 23, 2001

(30) Foreign Application Priority Data

Jan. 17, 2000 (JP) ..... 2000-007330

(51) Int. Cl.[7] ..... H01J 5/48; H01J 5/50; H01R 33/76

(52) U.S. Cl. ..... 313/318.01; 313/318.03; 313/318.05; 313/318.12; 439/683; 439/181; 439/182

(58) Field of Search ..... 313/318.01, 318.03, 313/318.05, 318.06, 318.02, 318.12; 439/683, 182, 181

(56) References Cited

U.S. PATENT DOCUMENTS 4,649,315 A * 3/1987 Inaba et al. ..... 313/325
4,822,301 A * 4/1989 Inaba et al. ..... 439/436
4,960,385 A * 10/1990 Kim ..... 439/182
5,007,850 A * 4/1991 Inaba et al. ..... 439/182
6,019,642 A * 2/2000 Nagata ..... 439/683
6,094,002 A * 7/2000 Bae et al. ..... 313/318.01

FOREIGN PATENT DOCUMENTS

EP 362979 A1 * 4/1990 ..... H01R/33/76
JP 6090786 6/1985 ..... H01R/33/945
JP 1027663 1/1998 ..... H01R/33/74
JP 1112670 * 5/1999 ..... H01R/33/74

* cited by examiner

*Primary Examiner*—Nimeshkumar D. Patel
*Assistant Examiner*—Sikha Roy
(74) *Attorney, Agent, or Firm*—Darby & Darby

(57) ABSTRACT

A CRT socket has a partition wall for partitioning a focus contact storing chamber and a base insertion hole which has sufficient strength, while maintaining a creepage distance between a focus contact and a signal contact sufficient to avoid arcing. The focus contact is formed in a leaf shape. A partition wall on a side of the base portion is interposed utilizing a gap in which a pin-type focus contact is interposed between a base and a focus pin in a cathode ray tube. The outside face of a projecting portion is covered with the partition wall. Increased strength is obtained in the partition wall for partitioning the focus contact storing chamber and the base insertion hole. The creepage distance between the focus contact and the signal contact is lengthened by forcing charges to travel, not only over the surfaces, but also along overlapping surfaces.

7 Claims, 9 Drawing Sheets

CRT SOCKET WITH INSULATING INTERFIT BETWEEN FOCUS AND SIGNAL CONTACTS

BACKGROUND OF THE INVENTION

1. Field of the Invention

This invention relates to the structure of a CRT (Cathode-Ray-Tube) socket for connecting a cathode ray tube used in a color television, etc., and particularly relates to a CRT socket for reliably insulating a focus contact and a signal contact from each other.

2. Description of the Background Art

Referring now to FIGS. 9 and 10, a base insertion hole 101, in a conventional CRT socket 100, is formed in an insulating housing 102. A plurality of signal contacts 103, 103, —and focus contacts 104, 104, —are formed at predetermined intervals in the insulating housing 102, around the outside of the base insertion hole 101, on the same circular circumference concentric to the base insertion hole 101.

A columnar base 100*a* of a CRT tube is inserted into the base insertion hole 101 and connected from a front face side (an upper side in FIG. 10) of the CRT socket 100 to the base insertion hole 101. A signal pin 100*b* and a focus pin 100*c*, arranged on the same circular circumference around the base 100*a*, respectively, are in physical and electrical contact with the signal contact 103 and the focus contact 104 facing the front face side.

The signal contact 103 and the focus contact 104 both have a conductive metallic plate that has been press-worked and formed in a bottle type (sometimes known as a banana plug) in which a connecting portion has a cylindrical shape and a drawn intermediate portion. The columnar signal pin 100*b* and the focus pin 100*c* are inserted into the drawn portion and are secured in place by a predetermined contact pressure.

A neck diameter of the cathode ray tube is reduced to make the cathode ray tube compact. As a result, the attaching positions of the contacts 103, 104 in the insulating housing 102 are closely spaced to each other. Accordingly, there is a concern that the focus contact 104 and the signal contact 103 are short-circuited along a surface of the insulating housing 102 since a high voltage of several thousands volts is applied to the focus pin 100*c*. To reduce the chance of such arc-over, the insulating housing 102 includes a ring-shaped portion 105 attached to the signal contact 103, a cover portion 106 attached to, the focus contact 104, and a base portion 109 covering the rear of the cover portion 106.

Creepage is defined as the conduction of electricity across the surface of a dielectric. A creepage distance is the distance along a dielectric that such conduction must occur for an arc to be formed. The creepage distance in the prior-art device is the distance along the surface of the insulating housing 102 between the focus contacts 104 and the signal contacts 103. The creepage distance is extended by interposing a slit 107 between the ring-shaped portion 105 and the cover portion 106. The rear face of a focus contact storing chamber 108 for storing a contact portion of the focus contact 104 is covered with the base portion 109. This construction reduces the chance of the above short circuit.

Referring now also to FIG. 11, the gap (L) between the base 100*a* and the focus pin 100*c* is very narrow to reduce the neck diameter of the cathode ray tube. In the conventional CRT socket 100, the focus contact 104 and a partition wall 106*a* of the cover portion 106 are interposed in this gap (L). Therefore, the thickness of the partition wall 106*a* is limited to a value that is less than desired. As a result, the strength of the partition wall 106*a* for partitioning the focus contact storing chamber 108 and the base insertion hole 101 is insufficient. Therefore, there is a chance that the partition wall 106*a* will be damaged when the cathode ray tube is forced into the socket at a slant when making the connection.

The rear face of the focus contact storing chamber 108 is covered by the base portion 109. A short-circuited electric current flows to an abutting portion of the cover portion 106 and the base portion 109, i.e., a rear face side of the ring-shaped portion 105 via a rear face of the partition wall 106. Accordingly, the distance between the focus contact 104 and the signal contact 103 cannot be made great enough to avoid arc-over.

OBJECTS AND SUMMARY OF THE INVENTION

To solve the above problems, an object of this invention is to provide a CRT socket in which a partition wall for partitioning a focus contact storing chamber and a base insertion hole has sufficient strength, and the creepage distance between a focus contact and a signal contact can be set to a sufficient length.

To solve the above problems, a CRT socket of the invention comprises an insulating housing in which the insulating housing is constructed by a ring-shaped portion in which a cylindrical base insertion hole is bored and plurality of signal contact storing chambers are concavely arranged from a rear face side on an outside circular circumference of the base insertion hole; a cover portion for arranging a focus contact storing chamber on the same circular circumference as the signal contact storing chambers by projecting a projecting portion concavely having the focus contact storing chamber from the rear face side to a portion having no ring-shaped portion; and a base portion for covering the rear face side of the cover portion; and the cover portion and the base portion are integrated with each other by molding the ring-shaped portion integrally with the cover portion or the base portion, and engaging the cover portion and the base portion with each other; a signal contact stored in each signal contact storing chamber; and a focus contact stored in the focus contact storing chamber; wherein a pin insertion hole communicated with the signal contact storing chamber and the focus contact storing chamber from front face sides of the ring-shaped portion and the projecting portion is bored, and a signal pin and a focus pin of a cathode ray tube arranged on an outside circular circumference of a base are respectively electrically connected to the signal contact and the focus contact, the CRT socket includes the focus contact constructed by a conductive metallic plate of a band shape, and an intermediate portion of the conductive metallic plate is bent at an acute angle, a bent basic end side is set to a supporting portion, and a bent tip side is set to a leaf spring contact portion; the supporting portion rises and is supported along an inner wall face of the focus contact storing chamber facing a direction of the base insertion hole, and the leaf spring contact portion faces the pin insertion hole; and an outside face of the projecting portion is covered with a partition wall rising on the front face side from the base portion.

The focus contact is formed in a leaf type in which an intermediate portion of the metallic plate of a band shape is bent at an acute angle. A supporting portion of the focus contact rises and is supported along an inner wall face facing the direction of the base insertion hole. Therefore, there is no focus contact interposed in a gap (L) between the base and the focus pin in the cathode ray tube. Accordingly, it is possible to increase the thickness of the partition wall to a thickness of the focus contact from the base portion, and cover the outside face of the projecting portion.

Since the partition wall of the base portion overlaps the, outside of a partition wall of the projecting portion, increased strength is obtained in the partition wall for partitioning the focus contact storing chamber and the base insertion hole.

The distance between the focus contact and the signal contact is extended by the partition wall rising from the base portion sufficiently to achieve sufficient length for mutual insulation.

The CRT socket of the invention includes the ring-shaped portion and the base portion being integrally molded. The cover portion is engaged with the base portion and is attached to the front face side of the base portion.

The signal contact is stored in the signal contact storing chamber concavely arranged from the rear face side of the ring-shaped portion. The focus contact is stored in the focus contact storing chamber concavely arranged in the cover portion.

Since the cover portion is engaged with the front face side of the base portion integrated with the ring-shaped portion, the focus contact is stored on the front face side and the signal contact is stored on the rear face side through the ring-shaped portion and the base portion. Accordingly, the distance between the focus contact and the signal contact can be easily lengthened.

The CRT socket according to a further embodiment of the invention includes a base portion formed in a box shape in which the partition wall rises along a peripheral portion of the base portion, and the cover portion is formed in a contour shape internally fitted to the box shape.

Since the base portion is formed in a box shape, the base portion is easily positioned with respect to the cover portion, and the base portion and the cover portion engage each other without rattling.

The CRT socket of the invention is characterized in that a pair of projecting portions forked into two branches is formed in the cover portion, and the focus contact is stored in the focus contact storing chamber of each projecting portion.

The outside face of the projecting portion is also covered with the partition wall rising from the base portion even in a double focus type having a pair of focus contacts. Accordingly, the distance between the respective focus contacts, or the distance between each focus contact and the signal contact can be set to a sufficient length to provide insulation.

The above, and other objects, features and advantages of the present invention will become apparent from the following description read in conjunction with the accompanying drawings, in which like reference numerals designate the same elements.

DESCRIPTION OF THE PREFERRED EMBODIMENTS

Figure 1:
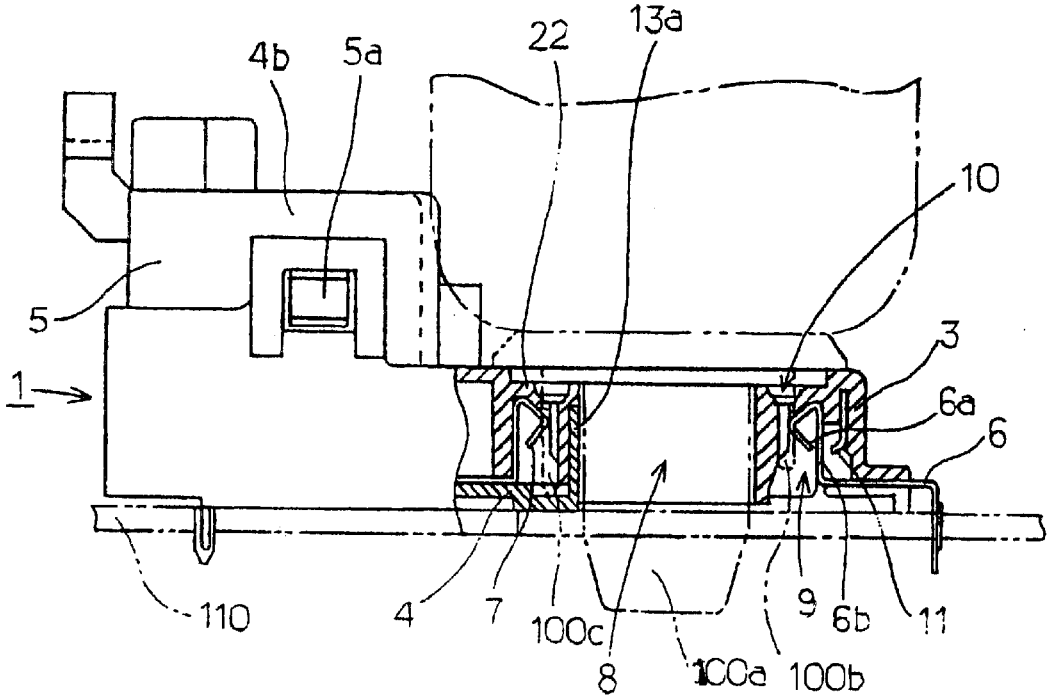
FIG. 1 is a partially broken side view of a CRT socket according to an embodiment of the present invention.

Referring to FIGS. 1, 2, 3 and 4(*a*)–4(*b*), a CRT socket 1 has an injection molded insulating housing 2 of synthetic resin. A plurality of signal contacts 6 and a pair of focus contacts 7 are attached to the insulating housing 2. The insulating housing 2 includes a ring-shaped portion 3, a base portion 4 and a cover portion 5. A base insertion hole 8 is formed at a center of the ring-shaped portion 3. The base portion 4 is arranged backward (leftward in FIG. 4) from the ring-shaped portion 3, and is integrally continuously connected to the ring-shaped portion 3. A front face side of the base portion 4 is covered with the cover portion 5.

The base insertion hole 8 is cylindrical with an inside diameter slightly larger than the outside diameter of a base 100*a* of the cathode ray tube so as to permit insertion of the base 100*a* from a front face side of the ring-shaped portion 3. In the ring-shaped portion 3, a signal contact storing chamber 9 is concavely arranged from a rear face in each of nine positions on the same circular circumference outside the base insertion hole 8. Each of nine signal contacts 6 is attached and stored in signal contact storing chamber 9 from the rear face side.

Figure 7:
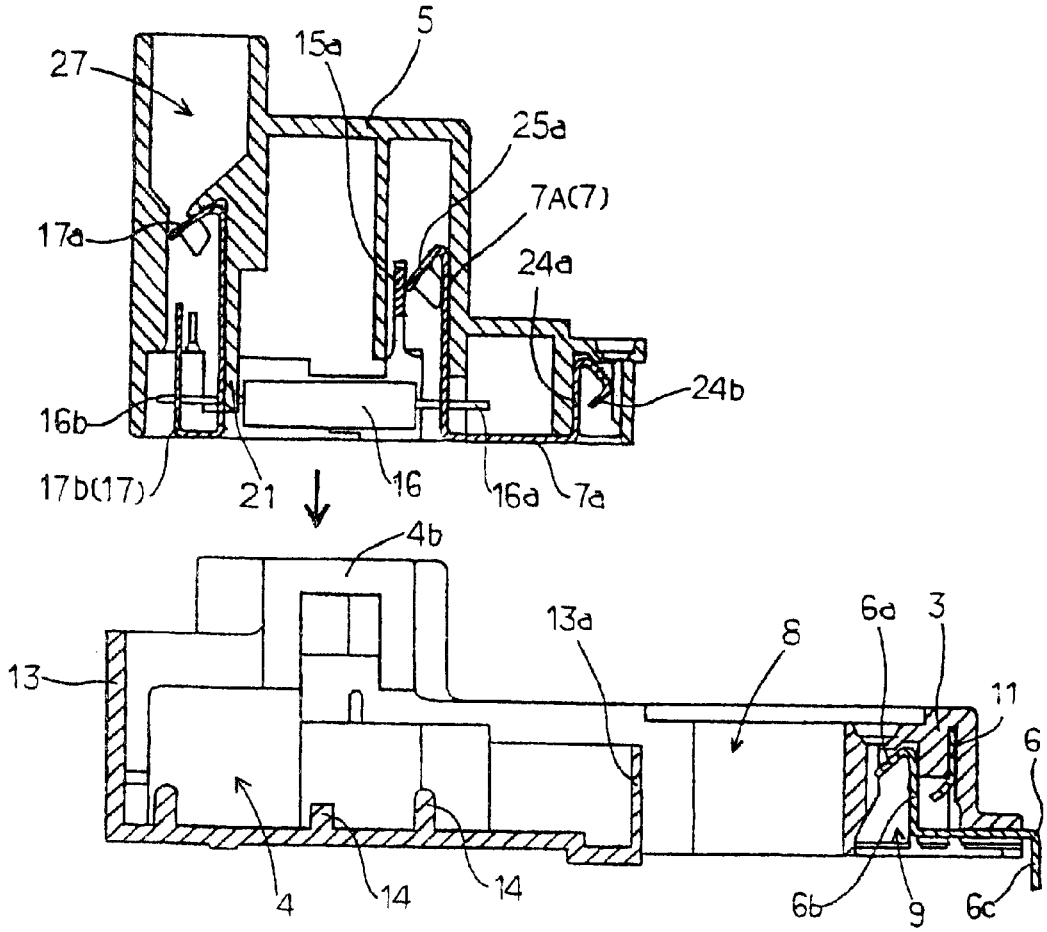
FIG. 7 is a longitudinal sectional view showing an attachment of the cover portion.

As shown in FIG. 7, each signal contact 6 is formed by bending a band-shaped elongated conductive metallic plate. One end of a supporting portion 6*b* is bent at an acute angle to form a signal contact portion 6*a*. The other end of the supporting portion 6*b* is double bent into a crank shape, with the outer portion of the crank shape forming a guiding portion 6*c*. The signal contact portion 6*a* is further bent in its intermediate portion on a side of the supporting portion 6*b* and is formed in a leaf type having an L-shape in section.

In this signal contact 6, engaging claws on both edges of the supporting portion 6*b* engaged inner walls of the signal contact storing chamber 9 to fixedly position the signal contact 6 in the ring-shaped portion 3. As best seen in FIG. 1, the supporting portion 6*b* passes upward within the signal contact storing chamber 9 with the signal contact 6 fixedly attached in the ring-shaped portion 3. The signal contact portion 6*a* is a cantilever spring projecting in a central direction (toward the base insertion hole 8) of the ring-shaped portion 3 with a side of the supporting portion 6*b* as a basic end. The guiding portion 6*c* is bent in the rear direction to project radially beyond the rear face of the ring-shaped portion 3 (hereinafter, a rear face direction of the insulating housing 2 is called downward and a front face direction of the insulating housing 2 is called upward in FIG. 1). The guiding portion 6*c* is soldered to a pattern of a printed wiring board 110.

An upper side of the signal contact storing chamber 9 communicates with the front face side of the ring-shaped portion 3 by a pin insertion hole 10. A signal pin 100*b* of the cathode ray tube is inserted into the pin insertion hole 10 and is guided downward by this pin insertion hole 10. The signal pin 100*b* inserted into the pin insertion hole 10 comes in elastic contact with the signal contact portion 6*a* of the signal contact 6 in the signal contact storing chamber 9.

A ring-shaped ground fitting 11 is exposed in a slight discharge gap outside the signal contact 6 within the signal contact storing chamber 9. When an abnormal voltage is applied to the signal contact 6, an electric current is discharged to the ground fitting 11.

Figure 4A:
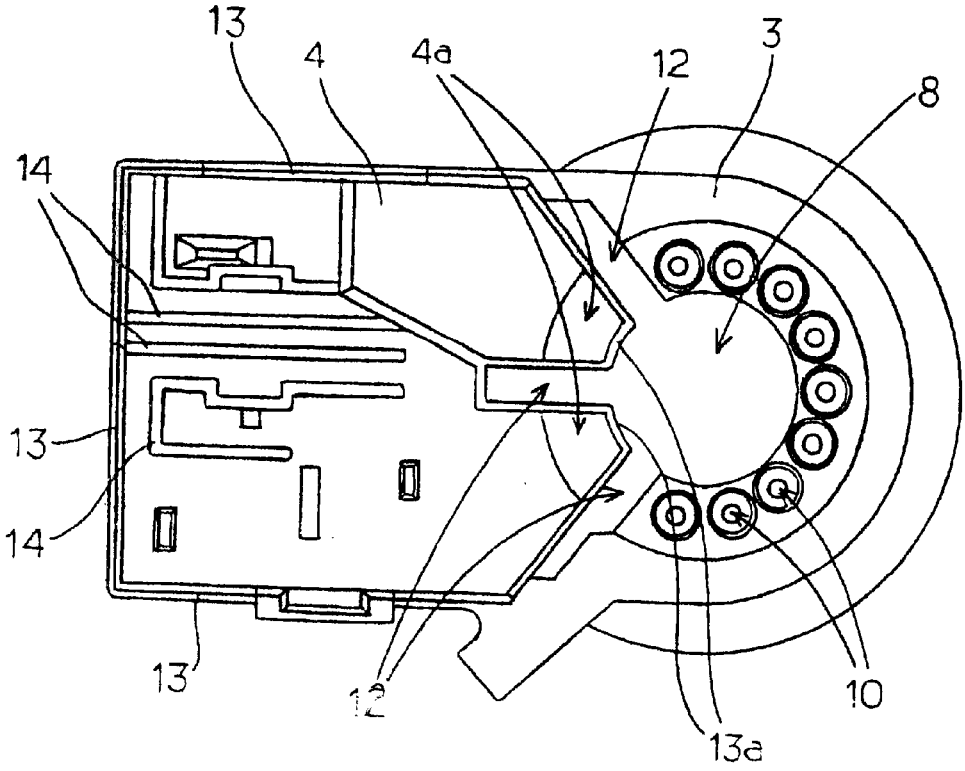
FIG. 4 is views showing respective portions of an insulating housing in which FIG. 4(*a*) is a plan view of a ring-shaped portion and a base portion, and FIG. 4(*b*) is a view of a cover portion.
Figure 4B:
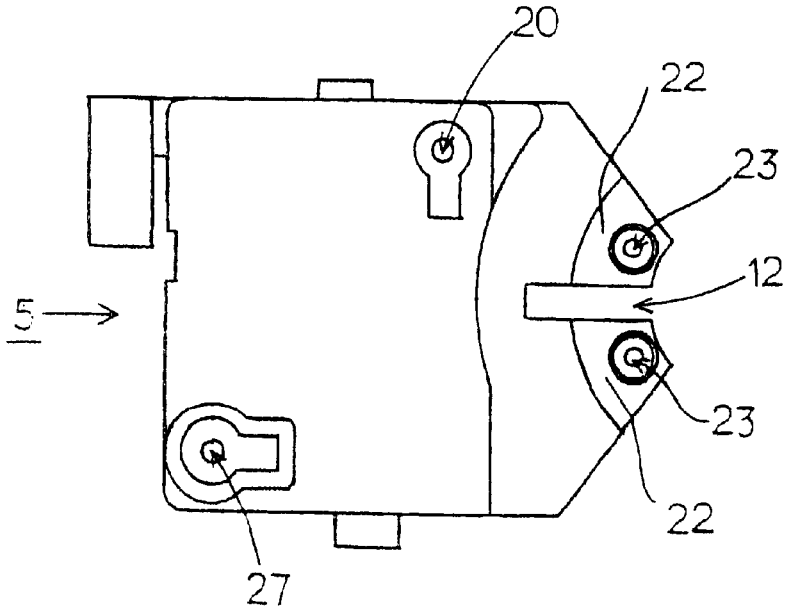

As can be clearly seen by comparing FIGS. 4(*a*) and 4(*b*), the base portion 4 continuously arranged backward from the ring-shaped portion 3 is formed in a shape in which the cover portion 5 is fitted to a plane contour from an outer side to cover an entire rear face of the cover portion 5. The base portion 4 is box shaped in which a partition wall 13 rises along this contour.

A front portion of the base portion 4 is divided by three slits 12, 12, 12 into a pair of fan-shaped concave portions 4*a*, 4*a* with the base insertion hole 8 as a center. The fan-shaped concave portions 4*a*, 4*a* are continuous on the same circle as the ring-shaped portion 3. The partition wall 13*a* covering a peripheral portion of each of the fan-shaped concave portions 4*a*, 4*a* constitutes one portion of an inner wall of the base insertion hole 8.

An engaging frame portion 4*b* extends upward on both sides of the base portion 4. The engaging frame portion 4*b* is integrally engaged with an engaging projection 5*a* of the cover portion 5, covering the rear face side of the cover portion 5. An insulating projection 14 is formed on an inner side of the base portion 4 surrounded by the partition wall 13. The insulating projection 14 projects into the cover portion 5 when the insulating projection 14 is installed in the cover portion 5. The insulating projection 14 prevents discharge between conductive portions such as the focus contact 7 located in the cover portion 5, etc.

Figure 6:
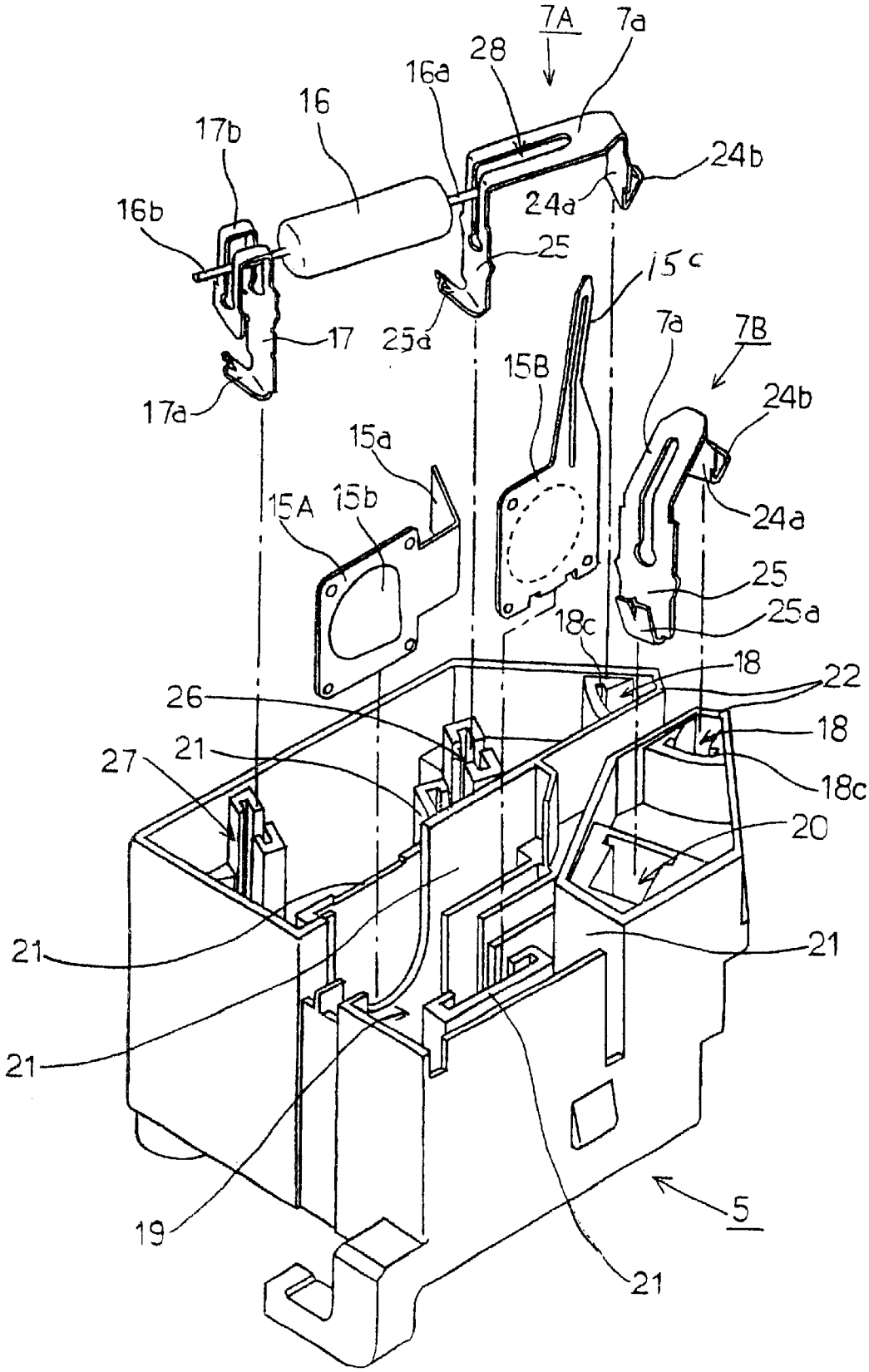
FIG. 6 is an exploded perspective view of the cover portion.

As shown in FIG. 6, a pair of focus contacts 7A, 7B, a pair of discharge electrode plates 15A, 15B, a resistance element 16 and a terminal 17 are disposed in the cover portion 5.

Focus contact storing chambers 18, 18 for storing the focus contacts 7A, 7B, a joint connecting chamber 26 connected to the focus contact 7 and the discharge electrode plate 15, a discharge chamber 19 oppositely arranged between the discharge electrode plates 15A and 15B, and lead connecting chambers 20, 27 in two places for inserting lead wires are respectively formed in concave portions spaced from the other chambers by an insulating projecting wall 21 formed vertically from an inner top face (an inner bottom face in FIG. 6) of the cover portion 5. When the base portion 4 and the cover portion 5 are engaged, a notched portion of this insulating projecting wall 21 is covered with the above insulating projection 14 of the cover portion 5 to prevent electrical discharge between the respective chambers.

Figure 2:
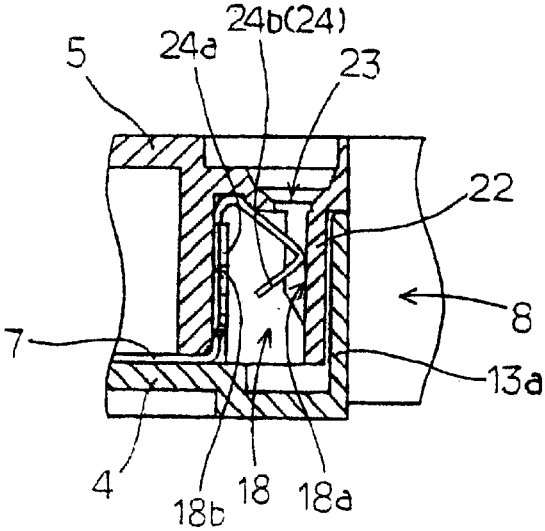
FIG. 2 is a longitudinal sectional view of a main portion of the CRT socket of FIG. 1.
Figure 3:
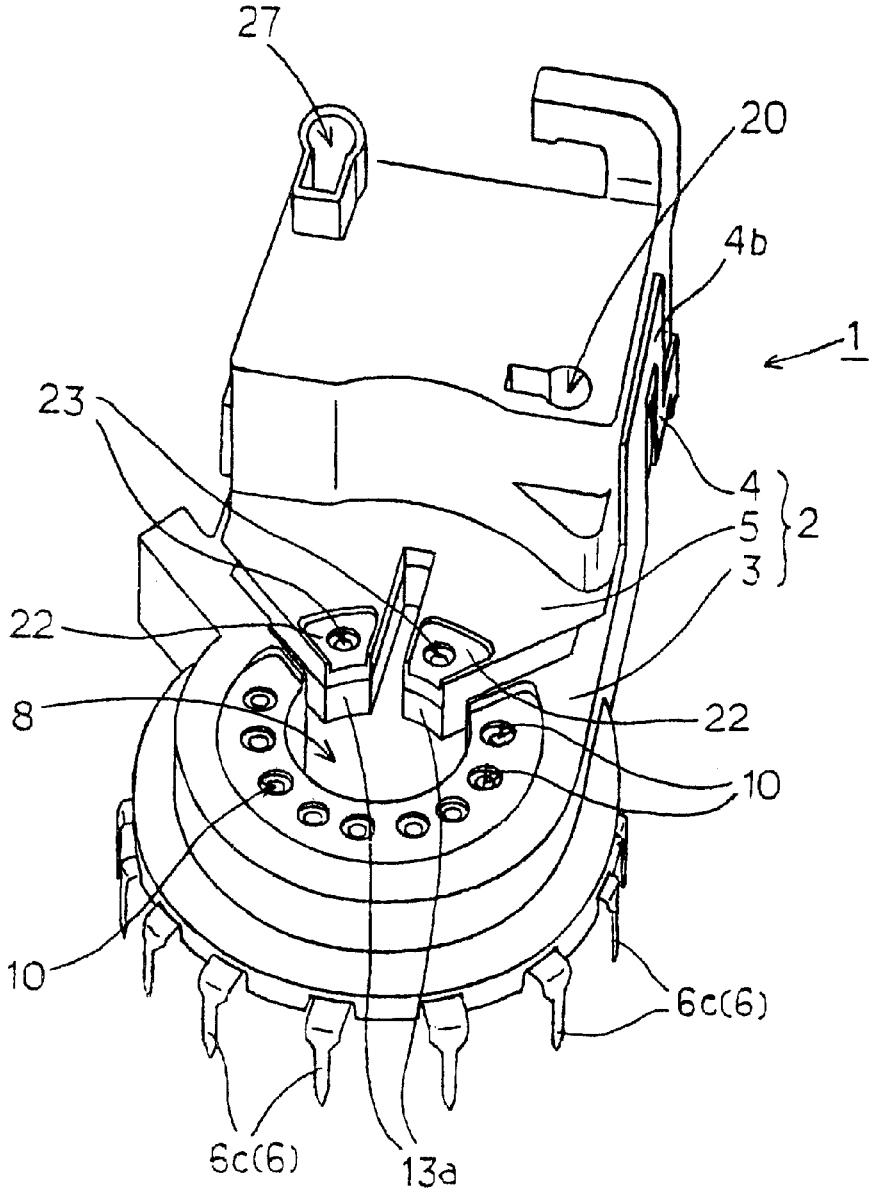
FIG. 3 is a perspective view of the CRT socket of FIG. 1.

Portions of the cover portion 5 fitted to the fan-shaped concave portions 4*a*, 4*a* of the base portion 4 on their inner sides are set to a pair of fan-shaped projecting portions 22, 22. The focus contact storing chambers 18, 18 are respectively concavely formed upward from a bottom side to this pair of projecting portions 22, 22. As shown in FIG. 2, an upper portion of the focus contact storing chamber 18 communicates with the front face side of the cover portion 5 through a focus pin insertion hole 23 into which the focus pin 100*c* is inserted. When the base portion 4 and the cover portion 5 are engaged with each other during assembly, the focus pin insertion hole 23 is located in a position on the same circular circumference as the signal contact storing chamber 9 for storing the signal contact 6, and is communicated with an upper portion of a front wall face 18*a* of the focus contact storing chamber 18. The focus pin insertion hole 23 guides the focus pin 100*c* of the cathode ray tube downward along the front wall face 18*a* of the focus contact storing chamber 18. A positioning groove 18*c* (see FIG. 6) for fixedly positioning the focus contact 7 in a vertical direction is concavely formed on both rear side faces in the focus contact storing chamber 18.

Figure 8A:
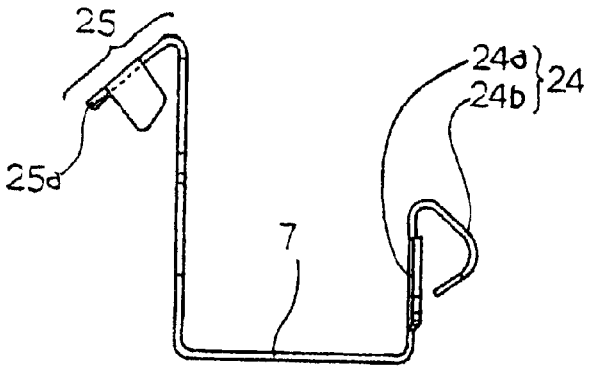
FIGS. 8(*a*), 8(*b*) and 8(*c*) are respectively front, side and bottom views of a focus contact.
Figure 8B:
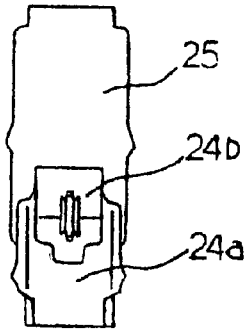
Figure 8C:
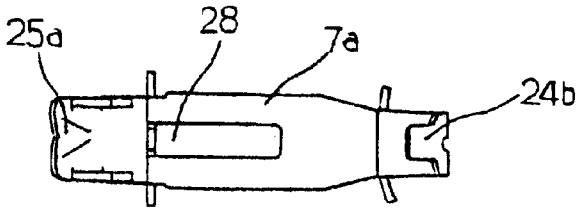
Figure 9:
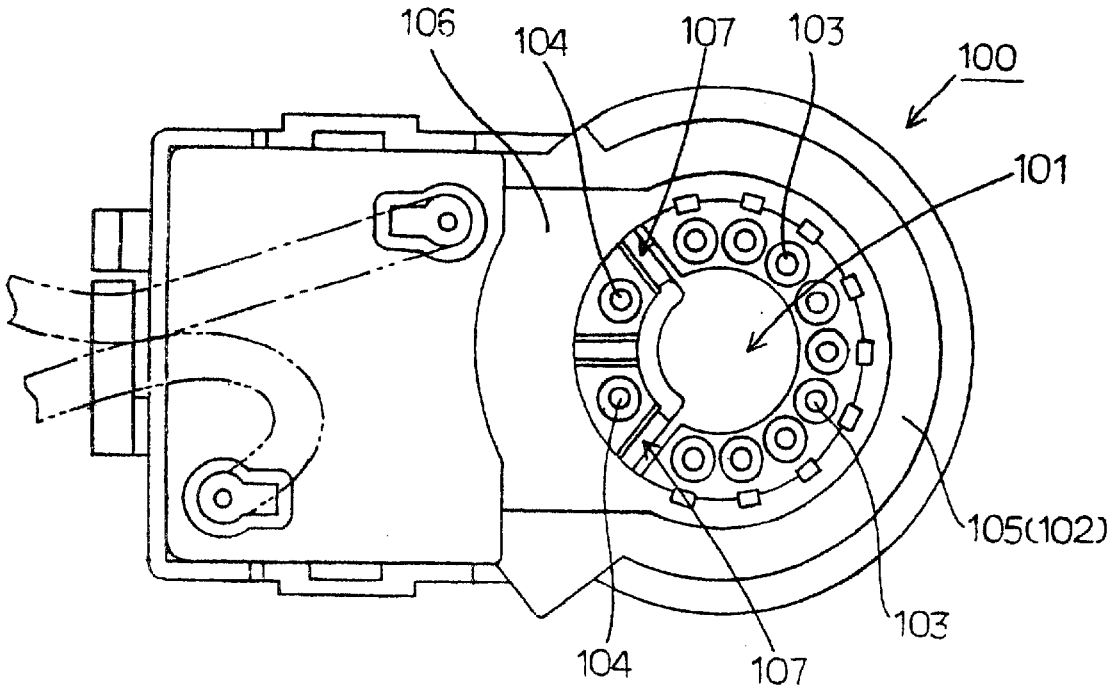
Fig.9 PRIOR ART
FIG. 9 is a plan view showing a conventional CRT socket.
Figure 10:
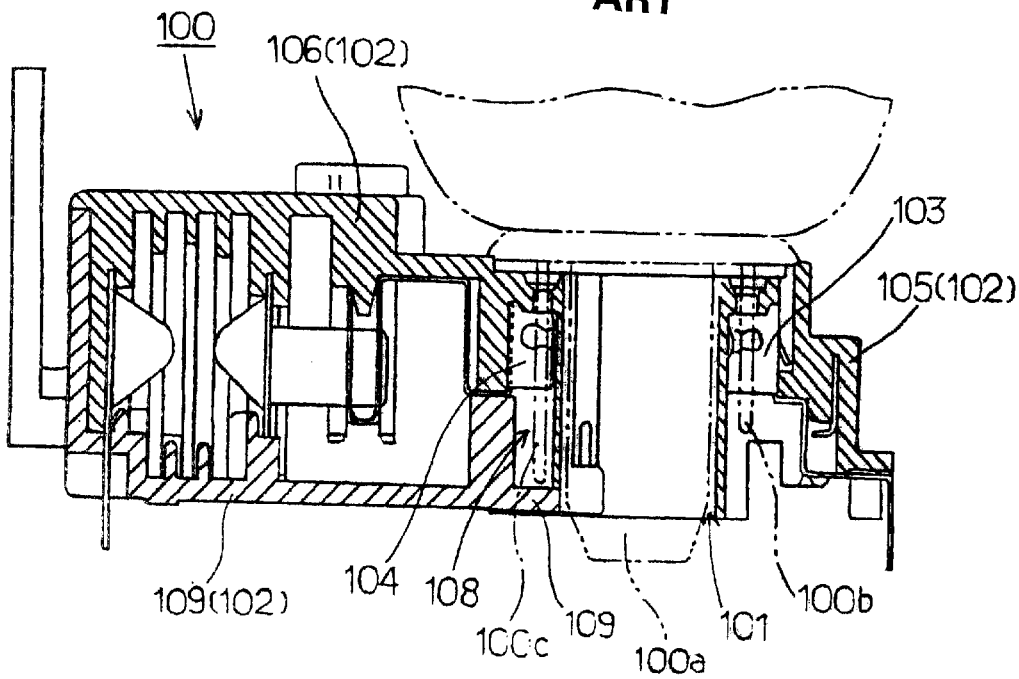
Fig.10 PRIOR ART
FIG. 10 is a longitudinal sectional view of the conventional CRT socket.
Figure 11:
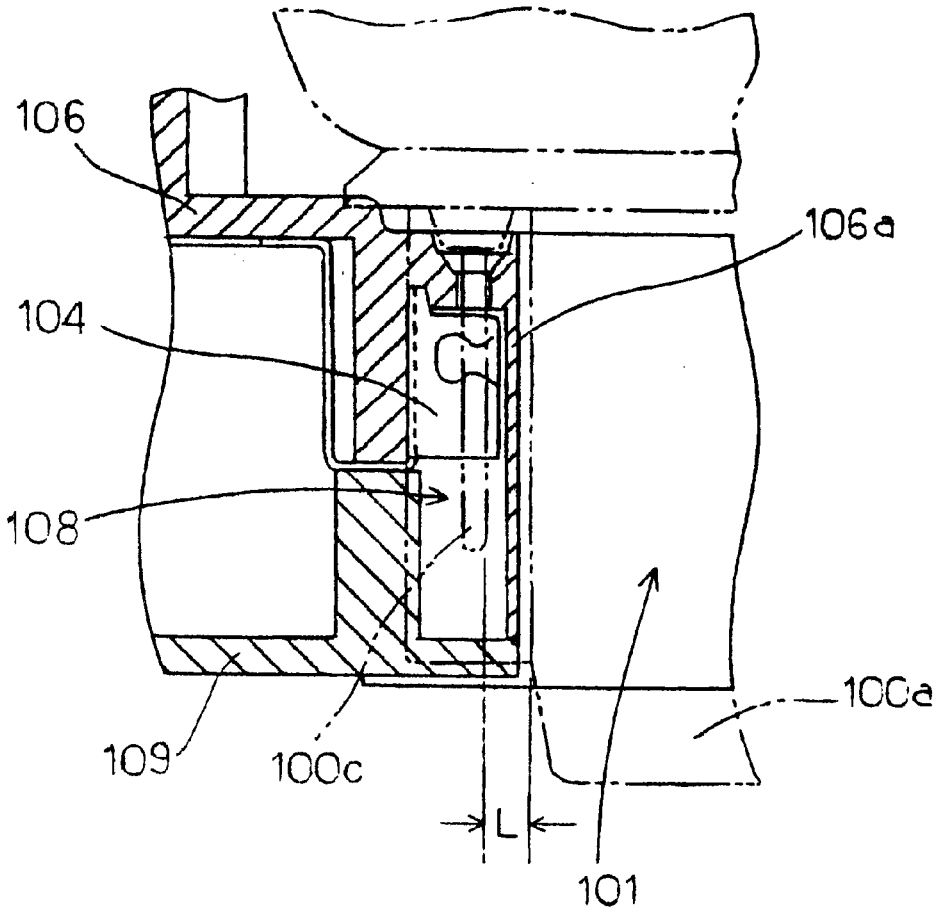
Fig.11 PRIOR ART
FIG. 11 is a longitudinal sectional view of a main portion of the conventional CRT socket.

The focus contact 7 is formed by bending a band-shaped elongated electrically conductive metallic plate. As shown in FIGS. 8(*a*)–8(*c*), a high voltage contact portion 24 and a spring contact portion 25 respectively extend upward on the sides of a connecting portion 7*a* in its longitudinal direction. The high voltage contact portion 24 is continuously arranged on a front side of the connecting portion 7*a*, and is constructed of a rising supporting portion 24*a* and a leaf contact portion 24*b*. An upper end of the supporting portion 24*a* is bent at an acute angle to form the leaf contact portion 24*b* on its free end. An intermediate portion of the leaf spring contact portion 24*b* is bent on a side of the supporting portion 24*a* so that the leaf spring contact portion 24*b* is formed in a leaf type of an L-shape in section.

The high voltage contact portion 24 of the focus contact 7 is installed in the focus contact storing chamber 18. As shown in FIG. 2, engaging claws on both sides of the supporting portion 24*a* engage respective positioning groove 18*c* to position and retain focus contact 7 in the focus contact storing chamber 18. In this stored state, the supporting portion 24*a* rises along a rear side face within the focus contact storing chamber 18, i.e., a rear wall face 18*b* facing a side of the base insertion hole 8. The leaf spring contact portion 24*b* acts as a cantilever spring facing a lower portion of the focus pin insertion hole 23 with an upper end of the supporting portion 24*a* as a basic end.

Figure 5:
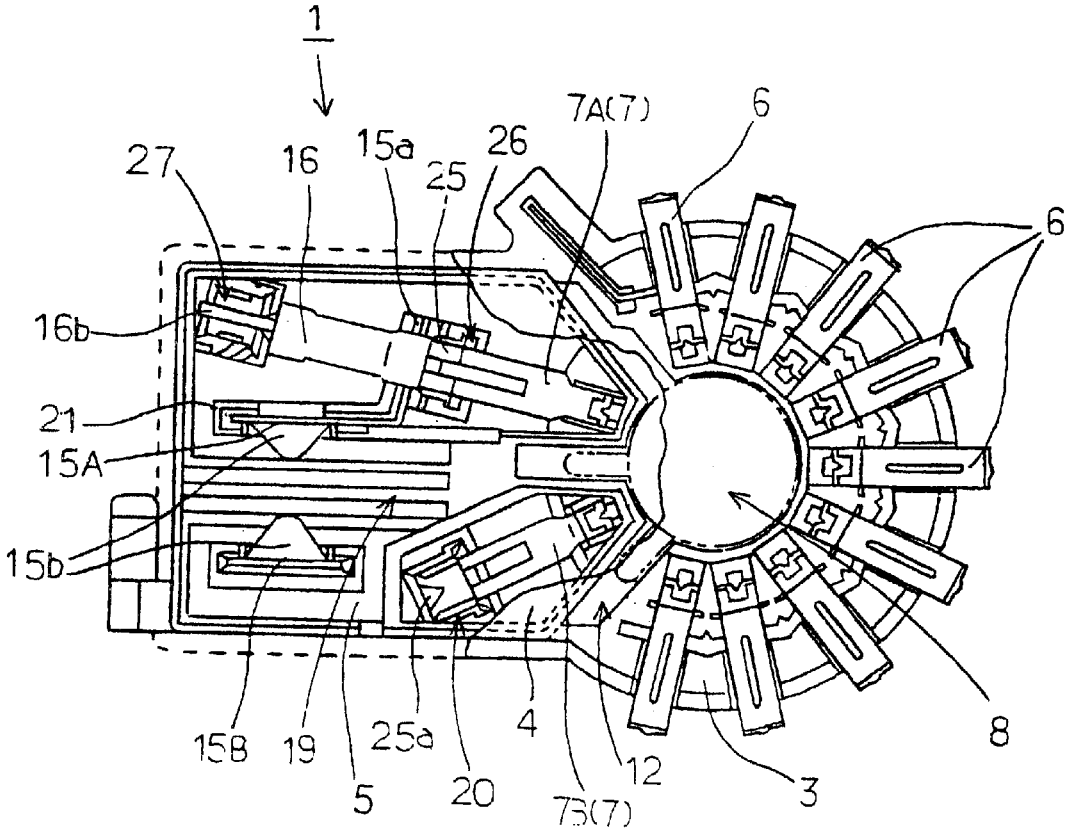
FIG. 5 is a bottom view of the CRT socket in which one portion of the base portion is broken away.

The spring contact portion 25 extends upward on a rear side of the connecting portion 7*a*. An upper end of the spring contact portion 25 forms a spring contact piece 25*a* bent at an acute angle on a rear side. As shown in FIGS. 5 and 6, the pair of focus contacts 7A, 7B are respectively attached to the cover portion 5 extending radially with the base insertion hole 8 as a center. The spring contact portion 25 of one focus contact 7A is inserted and positioned within the joint connecting chamber 26. A tip of the spring contact piece 25*a* comes in elastic contact with a connecting plate portion 15*a* of the discharge electrode plate 15A crossing and exposed within the joint connecting chamber 26. The spring contact portion 25 of the other focus contact 7B is inserted and positioned in a lead connecting chamber 20 opened on a front face side, and nips and electrically connects an unillustrated first external lead wire inserted from the front face side between the spring contact piece 25*a* and an inside face of the lead connecting chamber 20. The pair of focus contacts 7A, 7B connected to the discharge electrode plate 15 and the lead wire are formed in the same shape so that the same parts are commonly used and the number of parts is reduced and no error in connection is caused even when the focus contacts 7A, 7B are respectively attached on the other side.

Further, a press contact slit 28 is formed on a side of the focus contact 7A from a center of the connecting portion 7*a* to the spring contact portion 25 so permit electrical connection to an inside lead portion 16*a* of the resistance element 16. The width of the groove in the press contact slit 28 is slightly narrower than an outside diameter of the inside lead portion 10*b* of the resistance element 16. The inside lead portion 10*b*, inserted from the front face side to the press contact slit 28, comes into press contact with the press contact slit 28 and is connected to this press contact slit 28.

A discharge portion 15*b* of a semispherical shape is formed at the center of a rectangular plate in each of the pair of discharge electrode plates 15A, 15B. The discharge portions 15*b*, 15*b* are attached to the cover portion 5 along the insulating projecting wall 21 around the discharge chamber 19 such that the discharge portions 15*b*, 15*b* face each across the discharge chamber 19.

The connecting plate portion 15*a* of an L-shape crossing within the joint connecting chamber 26 is integrally formed on a side of the rectangular plate of the one discharge electrode plate 15A. The rectangular plate is connected to the spring contact portion 25 of the focus contact 7A as mentioned above. A leg portion 15*c* is vertically arranged integrally from the rectangular plate in the other discharge electrode plate 15B. The leg portion 15*c* is inserted into the base portion 4 where it is soldered to a ground pattern of the printed wiring board 110.

Thus, the focus contact 7A is connected to the discharge electrode plate 15A, and the ground pattern is connected to the discharge electrode plate 15B. The discharge portions 15*b*, 15*b* oppose each other across a discharge gap. When spark energy generated within the cathode ray tube is applied to the focus contact 7A, a discharge between the discharge portions 15*b* and 15*b* discharges electric current to the ground pattern.

Each lead connecting chamber 27 extends through front and rear sides of the cover portion 5 in a position of the cover portion 5 on an extension line of the focus contact 7A. As shown in FIG. 7, an intermediate inside diameter of the lead connecting chamber 27 is reduced so that an unillustrated second external lead wire inserted from the front face side is guided by the lead connecting chamber 27 to a terminal 17 extending from an intermediate portion to a downward portion (rear face side).

As shown in FIGS. 6 and 7, the terminal 17 is formed by bending a band-shaped conductive metallic plate to form a lead connecting piece 17*a* and a press contact connecting portion 17*b*. The lead connecting piece 17*a* is formed by bending this metallic plate at an acute angle on a rear side. A press contact slit is formed at a folding center of the press contact connecting portion 17*b*. An engaging claw projecting from a side face of the terminal 17 engages an inside face of the lead connecting chamber 27 so that the terminal 17 is retained in the lead connecting chamber 27. The upper lead connecting piece 17*a* faces an intermediate downward portion of the drawn lead connecting chamber 27, and nips and electrically connects the second external lead wire inserted from the front face side. When an outside lead portion 16*b* of the resistance element 16 comes in press contact with a press contact slit of the lower press contact connecting portion 17*b*, the resistance element 16 is positioned in a straight line collinear with the focus contact 7A, and the focus contact 7A to electrically connect the second external lead wire through the resistance element 16 and the terminal 17.

These parts in the cover portion 5 are respectively attached from above when an open face of the cover portion 5 on its rear face side is turned upward. Next, the cover portion 5 containing the respective parts therein is installed on a front face side of the base portion 4 with the cover portion 5 fitted into the partition wall 13 of the base portion 4. Then, an engaging projection 5*a* (see FIG. 1) of the cover portion 5 and an engaging frame portion 4*b* of the base portion 4 are engaged and integrated with each other. At this time, the partition wall 13*a* of the base portion 4 covers a peripheral portion of the projecting portion 22 forming the focus contact storing chamber 18 therein from the rear face side. Accordingly, the distance between each of-the focus contacts 7A, 7B and the signal contact 6, or the distance between the focus contacts 7A and 7B is sufficient to provide mutual insulation. Further, since the focus contact storing chamber 18 is doubly covered with the projecting portion 22 and the partition wall 13*a*, sufficient strength is obtained.

The present invention is not limited to the above embodiment mode, but can be variously modified. For example, the present invention may also have a structure in which the cover portion 5 and the ring-shaped portion 3 are integrally molded and the base portion 4 covering the rear face side of the cover portion 5 is separately molded and engaged with the cover portion 5.

In the embodiment shown and described, the CRT socket 1 is of a double focus contact type having two focus contacts 7A, 7B. However, the present invention can be also applied to a CRT socket having only one focus contact. The two focus contacts 7A, 7B have the same shape, but the shapes of the focus contacts 7A, 7B are not limited to the above example if the high voltage contact portion 24 coming in contact with the focus pin 100*c* is a leaf type.

In the above example, the base portion 4 is formed in a box shape in which the partition wall 13 rises along a peripheral portion of the base portion 4. However, if at least the partition wall 13*a* on a front face of the base portion 4 rises and is interposed between the projecting portion 22 and the base insertion hole 8, this base portion 4 is sufficiently used in the present invention.

In accordance with the invention, since the focus contact is a leaf type, no focus contact is interposed in a gap between the base and the focus pin in the cathode ray tube, and the partition wall 13*a* on a side of the base portion 4 can be interposed between the base and the focus pin. Accordingly, the partition wall for partitioning the focus contact storing chamber and the base insertion hole has sufficient strength, and the distance between the focus contact and the signal contact has a sufficient length.

Further, since the focus contact is a leaf type in which a conductive metallic plate of a band shape is bent and molded, the focus contact is easily manufactured in comparison with a bottle type.

In accordance with the invention, in addition to the foregoing invention, the ring-shaped portion and the base portion are further integrated with each other, and the focus contact is disposed on the front face side of the base portion, and the signal contact is disposed on the rear face side of the ring-shaped portion. Accordingly, the creepage distance between the focus contact and the signal contact is further lengthened.

In accordance with the invention, the base portion is formed in a box shape in addition to the invention in the foregoing paragraphs so that the base portion can be easily positioned with respect to the cover portion, and the base portion and the cover portion can be integrated with each other without rattling.

In accordance with the invention, each of outside faces of a pair of projecting portions is covered with the partition wall rising from the base portion. Accordingly, the distance between the respective focus contacts, or the distance between each focus contact and the signal contact is sufficient to provide adequate insulation.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A CRT socket comprising:

an insulating housing;

said insulating housing including a ring-shaped portion;

a base insertion hole in said ring-shaped portion;

a plurality of signal contact storing chambers;

said plurality of signal contact storing chambers are concavely arranged from a rear on an outside circular circumference of said base insertion hole;

a cover portion;

said cover portion including a focus contact storing chamber on the same circular circumference as said signal contact storing chambers;

said cover portion including a projecting portion concavely having said focus contact storing chamber from said rear to a portion having no ring-shaped portion;

a base portion covering a rear face of said cover portion;

said cover portion and said base portion are integrally formed with each other by molding said ring-shaped portion integrally with one of said cover portion and said base portion, and engaging the other of said cover portion and said base portion with the other thereof;

a signal contact in each signal contact storing chamber;

a focus contact in said focus contact storing chamber;

at least one pin insertion hole communicating with each said signal contact storing chamber and each said focus contact storing chamber from a front of respective said ring-shaped portion and said projecting portion;

a signal pin and a focus pin of a cathode ray tube arranged on an outside circular circumference of a base are respectively electrically connectable to respective said signal contact and said focus contact;

said focus contact is constructed from a band of conductive metal;

an intermediate portion of said band is bent at an acute angle;

a bent basic end side is a supporting portion;

a bent tip side of said band is a leaf spring contact portion;

said supporting portion rises and is supported along an inner wall face of said focus contact storing chamber facing toward said base insertion hole;

said leaf spring contact portion faces said pin insertion hole;

an outside face of said projecting portion is covered with a partition wall rising on said front from said base portion, wherein said projecting portion and said partition wall forming a rear face side wall of said focus contact storing chamber, said projecting portion and said partition wall positioned between said focus contact and said signal contact and partitioning said focus contact storing chamber and said base insertion hole; and said projecting portion and said partition wall insulating said focus contact storing chamber chamber.

2. The CRT socket as defined in claim 1, wherein:

said ring-shaped portion and said base portion are integrally molded;

said cover portion is engaged with said base portion and is attached to a front of said base portion.

3. The CRT socket as defined in claim 1, wherein:

said base portion is formed in a box shape in which said partition wall rises along a peripheral portion of said base portion; and said cover portion is formed in a contour shape internally fitted to said box shape.

4. The CRT socket as defined in any one of claim 1, wherein:

said cover portion includes a pair of projecting portion forked into two branches; and said focus contact is disposed in said focus contact storing chamber of each projecting portion.

5. A CRT socket comprising:

an insulating housing;

a base insertion hole in said housing;

at least one signal contact chamber in said housing spaced from said base insertion hole;

a signal contact in said at least one signal contact chamber;

a signal pin insertion hole in said housing aligned with said signal contact chamber;

a cover;

at least one focus chamber in said cover;

a focus contact in said at least one focus chamber;

a focus pin insertion hole aligned with said focus contact;

said focus contact being a resilient plate-type contact contacting a side of a focus pin remote from said base insertion hole;

said focus pin insertion hole guiding said focus pin into resilient contact with said focus contact and with an inner surface of said at least one focus chamber, whereby a reduced space is consumed by said focus contact;

said cover interfitting with said insulating housing with at least a portion of an interfit being an overlap of a portion of said cover with a portion of said housing in a vicinity of said focus chamber;

said interfit extending a creepage distance in said socket and strengthening said focus chamber; and said interfit positioned between said focus contact and said signal contact and partitioning said at least one focus chamber and said base insertion hole, said interfit insulating said focus chamber.

6. A CRT socket comprising:

a base insertion hole for receiving a base of a CRT;

a focus contact storing chamber contiguous with said base insertion hole;

a focus pin insertion hole communicating between said base insertion hole and said focus contact storing chamber;

said CRT being of a type having at least one focus pin for insertion through said focus pin insertion hole;

said focus contact storing chamber having a resilient contact high voltage contact portion therein;

said focus pin insertion hole guiding said focus pin between said resilient contact and a chamber wall of said focus contact storing chamber when said CRT is inserted into said base insertion hole, whereby a minimum of space is occupied for making electrical contact to said focus pin and an increased wall thickness and strength of said focus contact storing chamber is available;

said increased wall thickness positioned between said resilient contact and said base insertion hole and partitioning said focus contact storing chamber and said base insertion hole; and said increased wall thickness insulating said focus contact storing chamber.

7. A CRT socket comprising:

a base portion;

a base insertion hole in said base portion for receiving a CRT base;

a focus contact storing chamber in said base portion;

said CRT base including at least one focus pin;

a cover portion fittable on at least a portion of said base portion;

said cover portion having an overlap with a peripheral portion of said base portion at least on a creepage path for high voltage applied to said focus pin;

said overlap increasing a creepage distance by requiring high voltage creepage to travel, not only along a surface of said CRT socket, but also between surfaces of said overlap wherein said overlap is positioned between said focus pin and said base insertion hole and partitioning said focus contact storing chamber and said base insertion hole; and said overlap insulating said focus contact storing chamber.

* * * * *